US008104541B2

(12) United States Patent
Donald et al.

(10) Patent No.: US 8,104,541 B2
(45) Date of Patent: Jan. 31, 2012

(54) APPARATUS AND METHOD FOR PROCESSING FLUIDS FROM A WELL

(75) Inventors: Ian Donald, Aberdeenshire (GB); John Reid, Invergowrie (GB)

(73) Assignee: Cameron International Corporation, Houston, TX (US)

( * ) Notice: Subject to any disclaimer, the term of this patent is extended or adjusted under 35 U.S.C. 154(b) by 269 days.

(21) Appl. No.: 12/515,534

(22) PCT Filed: Nov. 15, 2007

(86) PCT No.: PCT/US2007/084879

§ 371 (c)(1),
(2), (4) Date: May 19, 2009

(87) PCT Pub. No.: WO2008/076565

PCT Pub. Date: Jun. 26, 2008

(65) Prior Publication Data

US 2010/0044038 A1 Feb. 25, 2010

(30) Foreign Application Priority Data

Dec. 18, 2006 (GB) ..... 0625191.2

(51) Int. Cl.
*E21B 33/043* (2006.01)
*E21B 41/04* (2006.01)

(52) U.S. Cl. ..... 166/342; 166/347; 166/348; 166/349; 166/360

(58) Field of Classification Search ..... None
See application file for complete search history.

(56) References Cited

U.S. PATENT DOCUMENTS

| | | | |
|---|---|---|---|
| 1,758,376 | A | 5/1930 | Sawyer |
| 1,944,573 | A | 1/1934 | Williams et al. |
| 1,944,840 | A | 1/1934 | Humason |
| 1,994,840 | A | 3/1935 | Thoen |
| 2,132,199 | A | 10/1938 | Yancey |
| 2,233,077 | A | 2/1941 | Gillespie et al. |
| 2,276,883 | A | 3/1942 | Schon et al. |
| 2,412,765 | A | 12/1946 | Buddrus et al. |
| 2,790,500 | A | 4/1957 | Jones |
| 2,962,356 | A | 11/1960 | Johns |

(Continued)

FOREIGN PATENT DOCUMENTS

AU 498216 4/1999

(Continued)

OTHER PUBLICATIONS

AU Examination Report dated Jul. 28, 2010, Application No. SG 200901449-9 (4 pp).

(Continued)

*Primary Examiner* — Zakiya W Bates
(74) *Attorney, Agent, or Firm* — Conley Rose, P.C.

(57) ABSTRACT

A system, including a first module (35*b*) configured to process fluid from a well, wherein the first module (35*b*) includes a processing device coupleable to a manifold (5), a first access tunnel (4*b*) extending through the processing device, wherein the access tunnel (4*b*) is configured to provide access to the manifold (5), a processing input (18*a*), and a processing output (19*a*). Further provided is a method of assembling a manifold, including coupling a processing module (35*b*) to a manifold (5), wherein the processing module comprises an access tunnel (4*b*) through the processing module (35*b*) that enables access to the manifold (5) while the processing module (35*b*) is coupled to the manifold (5).

15 Claims, 7 Drawing Sheets

U.S. PATENT DOCUMENTS 3,101,118 A 8/1963 Culver et al.
3,163,224 A 12/1964 Haeber et al.
3,358,753 A 12/1967 Haeber
3,378,066 A 4/1968 Otteman et al.
3,593,808 A 7/1971 Nelson
3,603,409 A 9/1971 Watkins
3,608,631 A 9/1971 Sizer et al.
3,688,840 A 9/1972 Curington et al.
3,705,626 A 12/1972 Glenn, Jr. et al.
3,710,859 A 1/1973 Hanes et al.
3,820,558 A 6/1974 Mueller
3,834,460 A 9/1974 Brun et al.
3,953,982 A 5/1976 Pennock
3,957,079 A 5/1976 Whiteman
4,046,191 A 9/1977 Neath
4,046,192 A 9/1977 Darnborough et al.
4,099,583 A 7/1978 Maus
4,210,208 A 7/1980 Shanks
4,223,728 A 9/1980 Pegg
4,260,022 A 4/1981 Van Bilderbeek
4,274,664 A 6/1981 Thominet
4,291,772 A 9/1981 Beynet
4,294,471 A 10/1981 Van Bilderbeek
4,401,164 A 8/1983 Baugh
4,403,658 A 9/1983 Watkins
4,405,016 A 9/1983 Best
4,457,489 A 7/1984 Gilmore
4,478,287 A 10/1984 Hynes et al.
4,502,534 A 3/1985 Roche et al.
4,503,878 A 3/1985 Taylor
4,509,599 A 4/1985 Chenoweth
4,589,493 A 5/1986 Kelly et al.
4,607,701 A 8/1986 Gundersen
4,626,135 A 12/1986 Roche
4,629,003 A 12/1986 Baugh
4,630,681 A 12/1986 Iwamoto
4,646,844 A 3/1987 Roche et al.
4,695,190 A 9/1987 Best et al.
4,702,320 A 10/1987 Gano et al.
4,721,163 A 1/1988 Davis
4,756,368 A 7/1988 Ikuta et al.
4,813,495 A 3/1989 Leach
4,820,083 A 4/1989 Hall
4,830,111 A 5/1989 Jenkins et al.
4,832,124 A 5/1989 Rayson
4,848,471 A 7/1989 Bencze et al.
4,848,473 A 7/1989 Lochte
4,848,475 A 7/1989 Dean et al.
4,874,008 A 10/1989 Lawson
4,896,725 A 1/1990 Parker et al.
4,899,822 A 2/1990 Daeschler et al.
4,911,240 A 3/1990 Haney et al.
4,919,207 A 4/1990 Ikuta et al.
5,010,956 A 4/1991 Bednar
5,025,865 A 6/1991 Caldwell et al.
5,044,672 A 9/1991 Skeels et al.
5,069,286 A 12/1991 Roensch et al.
5,085,277 A 2/1992 Hopper
5,143,158 A 9/1992 Watkins et al.
5,213,162 A 5/1993 Iato
5,248,166 A 9/1993 Wilkins
5,255,745 A 10/1993 Czyrek
5,280,766 A 1/1994 Mohn
5,295,534 A 3/1994 Porter
5,299,641 A 4/1994 Paulo et al.
5,456,313 A 10/1995 Hopper et al.
5,462,361 A 10/1995 Sato et al.
5,535,826 A 7/1996 Brown et al.
5,544,707 A 8/1996 Hopper et al.
5,678,460 A 10/1997 Walkowc
5,719,481 A 2/1998 Mo
5,730,551 A 3/1998 Skeels et al.
5,807,027 A 9/1998 Oestergaar et al.
5,868,204 A 2/1999 Pritchett et al.
5,944,152 A 8/1999 Lindsay et al.
5,971,077 A 10/1999 Lilley
5,992,527 A 11/1999 Garnham et al.
6,039,119 A 3/2000 Hopper et al.
6,050,339 A 4/2000 Milberger
6,053,252 A 4/2000 Edwards
6,076,605 A 6/2000 Lilley et al.
6,098,715 A 8/2000 Seixas et al.
6,109,352 A 8/2000 Edwards et al.
6,116,784 A 9/2000 Brotz
6,123,312 A 9/2000 Dai
6,138,774 A 10/2000 Bourgoyne, Jr. et al.
6,145,596 A 11/2000 Dallas
6,182,761 B1 2/2001 Bednar
6,227,300 B1 5/2001 Cunningham et al.
6,296,453 B1 10/2001 Layman
6,321,843 B2 11/2001 Baker
6,352,114 B1 3/2002 Toalson et al.
6,388,577 B1 * 5/2002 Carstensen ..... 340/854.3
6,457,529 B2 10/2002 Calder et al.
6,457,530 B1 10/2002 Lam et al.
6,457,540 B2 10/2002 Gardes
6,460,621 B2 10/2002 Felton et al.
6,484,807 B2 11/2002 Allen
6,494,267 B2 12/2002 Allen
6,497,286 B1 12/2002 Hopper
6,557,629 B2 5/2003 Wong et al.
6,612,368 B2 9/2003 Kent et al.
6,637,514 B1 10/2003 Donald et al.
6,651,745 B1 11/2003 Lush et al.
6,755,254 B2 6/2004 DeBerry
6,760,275 B2 7/2004 Carstensen
6,805,200 B2 10/2004 DeBerry
6,823,941 B2 11/2004 Donald
6,840,323 B2 1/2005 Fenton et al.
6,966,383 B2 11/2005 Milberger et al.
7,040,408 B2 5/2006 Sundararajan et al.
7,111,687 B2 9/2006 Donald et al.
7,201,229 B2 4/2007 White et al.
7,210,530 B2 5/2007 Lush et al
7,270,185 B2 9/2007 Fontana et al.
7,363,982 B2 4/2008 Hopper
7,569,097 B2 8/2009 Campen et al.
7,658,228 B2 2/2010 Moksvold
7,699,099 B2 4/2010 Bolding
7,718,676 B2 5/2010 Moussy et al.
7,740,074 B2 6/2010 White et al.
7,757,772 B2 7/2010 Donohue et al.
7,770,653 B2 8/2010 Hill
7,823,648 B2 11/2010 Bolding
2001/0050185 A1 12/2001 Calder et al.
2002/0000315 A1 1/2002 Kent et al.
2002/0070026 A1 6/2002 Fenton et al.
2002/0074123 A1 6/2002 Regan
2003/0145997 A1 8/2003 Langford et al.
2003/0146000 A1 8/2003 Dezen et al.
2004/0057299 A1 3/2004 Kozakai et al.
2004/0154790 A1 8/2004 Cornelssen et al.
2004/0251030 A1 12/2004 Appleford
2005/0028984 A1 2/2005 Donald et al.
2005/0058535 A1 3/2005 Meshenky et al.
2005/0109514 A1 5/2005 White et al.
2005/0173322 A1 8/2005 Ostergaard
2005/0263194 A1 12/2005 Tseng et al.
2006/0237194 A1 10/2006 Donald et al.
2007/0144743 A1 6/2007 White et al.
2008/0128139 A1 6/2008 White
2008/0169097 A1 7/2008 Bolding et al.
2009/0025936 A1 1/2009 Donald et al.
2009/0126938 A1 5/2009 White
2009/0260831 A1 10/2009 Moksvold
2009/0266542 A1 10/2009 Donald et al.
2009/0266550 A1 10/2009 Felton
2009/0294125 A1 12/2009 Donald et al.
2009/0294132 A1 12/2009 Donald et al.
2009/0301727 A1 12/2009 Donald et al.
2009/0301728 A1 12/2009 Donald et al.
2010/0025034 A1 2/2010 Donald et al.
2010/0206546 A1 8/2010 Donald et al.
2010/0206547 A1 8/2010 Donald et al.
2010/0206576 A1 8/2010 Donald et al.

FOREIGN PATENT DOCUMENTS

| | | |
|---|---|---|
| BR | 10415841 | 3/2007 |
| CH | 638019 | 8/1983 |
| DE | 2541715 | 4/1976 |
| DE | 3738424 | 5/1989 |
| EP | 0036213 | 9/1981 |
| EP | 0568742 | 11/1993 |
| EP | 0572732 | 12/1993 |
| EP | 0719905 | 3/1996 |
| EP | 0841464 | 5/1998 |
| EP | 1990505 | 9/2002 |
| EP | 1639230 | 1/2009 |
| EP | 1918509 | 10/2009 |
| FR | 2710946 | 4/1995 |
| GB | 2424913 | 11/1925 |
| GB | 1022352 | 3/1966 |
| GB | 2197675 | 5/1998 |
| GB | 2319795 | 6/1998 |
| GB | 2346630 | 8/2000 |
| GB | 2361726 | 10/2001 |
| GB | 0312543.2 | 5/2003 |
| GB | 0405454.0 | 3/2004 |
| GB | 0405471.4 | 3/2004 |
| GB | 2445493 | 7/2008 |
| NO | 20051778 A | 10/2006 |
| WO | WO 90/08897 | 8/1990 |
| WO | 96/30625 | 10/1996 |
| WO | 98/15712 | 4/1998 |
| WO | WO99/06731 | 2/1999 |
| WO | 99/28593 | 6/1999 |
| WO | 99/49173 | 9/1999 |
| WO | 0047864 | 8/2000 |
| WO | WO0047864 | 8/2000 |
| WO | WO00/53937 | 9/2000 |
| WO | 00/70185 | 11/2000 |
| WO | 02/38912 | 5/2002 |
| WO | 02/088519 | 11/2002 |
| WO | 03033868 | 4/2003 |
| WO | WO03033868 | 4/2003 |
| WO | 03078793 | 9/2003 |
| WO | WO03078793 | 9/2003 |
| WO | 2005047646 | 5/2005 |
| WO | WO2005/040545 | 5/2005 |
| WO | WO2005047646 | 5/2005 |
| WO | 2005083228 | 9/2005 |
| WO | WO2005083228 | 9/2005 |
| WO | WO 2006/041811 | 4/2006 |
| WO | 2007079137 | 7/2007 |
| WO | WO 2008/034024 | 3/2008 |

OTHER PUBLICATIONS

AU Response to Examiner's Report dated Sep. 14, 2010, Application No. 2004289864 (23 pp) Response filed Dec. 7, 2010.

AU Examiner's Report No. 3 dated Dec. 13, 2010, Application No. 2004289864.

Canadian Office Action dated Dec. 6, 2010, Application No. 2,526,714 (3 pp).

EP Article 96(2) Communication dated Jun. 12, 2007, Application No. 05717806.3 (3 pp).

EP Response to Article 96(2) Communication dated Jun. 12, 2007, Application No. 05717806.3 (17 pp) Response filed Sep. 19, 2007.

EP Response to Exam Report dated May 4, 2010, Application No. 07864486.1 (10 pp) Response filed Nov. 12, 2010.

EP Response to Exam Report dated Aug. 2, 2010, Application No. EP10161117.6 (6 pp) Response filed Dec. 2, 2010.

EP Response to Exam Report dated Aug. 2, 2010, Application No. EP10161116.8 (13 pp) Response filed Dec. 2, 2010.

EP Response to Exam Report dated Aug. 4, 2010, Application No. EP10161120.0 (6 pp) Response filed Dec. 2, 2010.

Response to EP Exam Report dated Oct. 14, 2010, Application No. 10167181.6 (6 pp) Response filed Feb. 9, 2011.

Response to EP Exam Report dated Oct. 14, 2010, Application No. 10167183.2 (4 pp) Response filed Feb. 14, 2011.

Response to EP Exam Report dated Oct. 14, 2010, Application No. 10167182.4 (6 pp) Response filed Feb. 10, 2011.

Response to EP Exam Report dated Oct. 14, 2010, Application No. 10167184.0 (8 pp) Response filed Feb. 10, 2011.

EP Search Report and Opinion dated Dec. 2, 2010, Application No. 10185612.8 (4 pp).

EP Search Report and Opinion dated Dec. 3, 2010, Application No. 10185795.1 (4 pp).

EP Search Report dated Dec. 9, 2010, Application No. EP10013192 (3 pp).

EP Office Action Pursuant to Article 94(3) dated Dec. 29, 2010, Application No. 06024001.7 (4 pp).

Norwegian Office Action dated Oct. 20, 2010, Application No. 20032037 (4 pp).

Notice of Litigation for U.S. Appl. No. 10/558,593 (77 pp).

A750/09, In the Court of Session, Intellectual Property Action, Closed Record, in the Cause *D.E.S. Operations et al.* vs. *Vetco Gray Inc. et al.*, Updated record to include adjusted Answers to Minute of Amendment, Oct. 21, 2010 (90 pp).

A750/09; In the Court of Session, Intellectual Property Action, Note of Arguments for the First to Fifth Defenders, Dec. 30, 2010 (18 pp).

A750/09; In the Court of Session; Intellectual Property Cause; Response for the Pursuers to the Note of Argument for the Defenders (Mar. 3, 2011) (12 pp).

A750/09; In the Court of Session, Intellectual Property Action, Open Record, D.E.S. Operations Limited, Cameron Systems Ireland Limited [Pursuers] against Vetco Gray Inc., Paul White, Paul Milne and Norman Brammer [Defenders] Adjusted for the Pursuers Feb. 9, 2010, as further adjusted for the Pursuers Apr. 6, 2010 (53 pp).

Initiation of Proceedings Before the Comptroller, Oct. 22, 2009; In the Matter of DES Operations Limited and Cameron Systems Ireland Limited and Vetco Gray Inc., and in the Matter of an Application Under Sections 133, 91A, 121A, and 371 of the Patent Act 1977, Statement of Grounds, Oct. 22, 2009 (21pp).

Response to Written Opinion dated Oct. 12, 2010, Application No. 200903221-0 (14 pp) Response filed Mar. 8, 2011.

Provisional Application filed Feb. 26, 2004, U.S. Appl. No. 60/548,727.

Response to Office Action dated Aug. 31, 2010, U.S. Appl. No. 10/590,563 (8 pp) Response filed Nov. 29, 2010.

Response to Office Action dated Oct. 6, 2010, U.S. Appl. No. 12/541,938 (8 pp) Response filed Jan. 11, 2011.

Office Action dated Dec. 7, 2010, U.S Appl. No. 12/541,936 (6 pp).

Response to Office Action dated Dec. 7, 2010, U.S. Appl. No. 12/541,936 (9 pp) Response filed Jan. 20, 2011.

Notice of Allowance dated Jan. 6, 2011, U.S. Appl. No. 10/558,593 (26 pp).

Final Office Action dated Feb. 3, 2011, U.S. Appl. No. 12/441,119.

Office Action dated Feb. 16, 2011, U.S. Appl. No. 12/541,937.

Final Office Action dated Mar. 2, 2011, U.S. Appl. No. 10/590,563.

Norwegian Office Action dated Mar. 28, 2011, Application No. 2001 5431 Recovery of Production Fluids From an Oil or Gas Well (3 pp).

Response to Final Office Action dated Feb. 3, 2011, U.S. Appl. No. 12/441,119 Response filed Mar. 30, 2011 (11 pp).

Final Office Action dated Mar. 30, 2011, U.S. Appl. No. 12/541,938 (40 pp).

Notice of Allowance dated Apr. 1, 2011, U.S. Appl. No. 12/541,936 (40 pp).

PCT International Search Report and Written Opinion for PCT/US2007/084879, dated Jun. 13, 2008.

Official Communication dated Mar. 5, 2003 for Appl. No. 00929690.6 (2 p.).

Response to Official Communication dated Mar. 5, 2003 for Appl. No. 00929690.6; (5 p.).

Official Communication dated Aug. 29, 2003 for Appl. No. 00929690.6; (3 p.).

Examination Report dated Apr. 28, 2004 for Appl. No. 00929690.6; (3 p.).

Response Examination Report dated Apr. 28, 2004 for Appl. No. 00929690.6; (20).

Examination Report dated May 18, 2009 for EP Appl. No. 08162149.2; (8).

Response to EP Examination Report dated May 18, 2009 for Appl. No. 08162149.2; (132 p.).

Response to Article 94(3) and Rule 71(1) Communication dated May 18, 2009 for Appl. No. 08162149.2; (3 p.).
Search Report dated Jun. 25, 10 for EP Appl. 10 16 1116 (3 p.).
Search Report dated Jun. 25, 10 for EP Appl. 10 16 1117 (2 p).
Search Report dated Jun. 25, 10 for EP Appl. 10 16 1120 (2 p.).
Norwegian Examination Report dated Aug. 19, 2005 for Appl. 2001 5431; (6 p.) (w/uncertified translation).
Response to Norwegian Examination Report dated Aug. 19, 2005 Appl. 2001 5431 (w/uncertified translation).
Examination Report dated Mar. 22, 2010 for Norwegian Appl. 2003 2037 (8 p.) w/uncertified translation).
PCT International Search Report for Appl. PCT/GB01/04940 dated Mar. 4, 2002; (3 p.).
Search Report and Written Opinion dated Sep. 22, 2004 for Appl. PCT/GB2004/002329 (13 p.).
Search Report and Written Opinion for Appl. PCT/GB2005/000725 dated Jun. 7, 2005; (8 p.).
Search Report and Written Opinion for Appl. PCT/GB2005/003422 dated Jan. 27, 2006; (8 p.).
Search Report and Written Opinion for Appl. PCT/GB2004/002329 dated Apr. 16, 2007; (10 p.).
Search Report and Written Opinion for Appl. PCT/US2007/078436 dated Aug. 12, 2008 (11 p).
Baker Hughes; Intelligent Well System; A Complete Range of Intelligent Well Systems; (undated) (4 p.).
Patent Search Report (INPADOC Patent Family) (3 p.) Undated.
Venture Training Manual Part 1 (p. 48) (Undated).
Venture Training Manual Part 2 (p. 25) (Undated).
Petroleum Abstracts Oct. 30, 2001; (79 p).
Petroleum Abstracts Oct. 25, 2001; (48 p).
Derwent Abstracts Nov. 2, 2001; (16 p).
ABB Retrievable Choke Insert; (pp. 3, 8) (Undated).
ABB Brochure entitled "Subsea Chokes and Actuators" dated Oct. 2002 (12 p).
Online publication; Weatherford RamPump dated Aug. 10, 2005; (2 p.).
Offshore Article "Multiphase Pump" dated Jul. 2004; (1 p) (p. 20).
Kvaerner Oilfield Products A.S. Memo—Multiphase Pumping Technical Issues dated May 19, 2004 (10 p.).
Framo Multiphase Booster Pumps dated Aug. 10, 2005; (1 p).
Kvaerner Pump Photo (Undated) (1 p.).
Aker Kvaerner; Multibooster System; (4 p.) (undated).
"Under Water Pump for Sea Bed Well" by A. Nordgren, Dec. 14, 1987; Jan 27, 200.
Force Pump, Double-Acting, Internet, Glossary dated Sep. 7, 2004; (2 p.).
Progressing Cavity and Piston Pumps; National Oilwell (2 P.) (Undated).
JETECH DA-4D & DA-8D Ultra-High Pressure Increases; (3 p.) (undated).
Weatherford Artificial Lift Systems (2 p.) (undated).
Examination Report for Singapore Appl. SG200507390-3 dated Jan. 10, 2007; (5 p.).
Office Action dated Mar. 25, 2004 for U.S. Appl. No. 10/415,156 (6 p.).
Response to Office Action dated Mar. 25, 2004 for U.S. Appl. No. 10/415,156 (9 p.).
Notice of Allowance dated Jul. 26, 2004 for U.S. Appl. No. 10/415,156 (4 p.).
U.S. Appl. No. 60/513,294, filed Oct. 22, 2003 (15 p.).
U.S. Appl. No. 60/548,630, filed Feb. 23, 2004 (23 p.).
U.S. Appl. No. 61/190,048, filed Nov. 19, 2007 (24 p.).
Australian Examination Report dated Jul. 3, 2003 for Appl. No. 47694/00 (2 p.).
Response to Australian Examination Report dated Jul. 3, 2003 for Appl. No. 47694/00 (20 p.).
Australian Examination Report dated Jul. 21, 2006 for Appl. No. 2002212525; (2 p.).
Response to Australian Examination Report dated Jul. 21, 2006 for Appl. No. 2002212525; (33 p.).
Brazilian Examination Report dated Apr. 3, 2008 for Appl. PI0115157-6; (3 p.).
Response to Brazilian Examination Report of Apr. 3, 2008 for Appl. PI0115157-6 ; (7 p.).
Canadian Office Action dated Jan. 10, 2007 for Appl. No. 2,373,164; (2 p.).
Response to Canadian Office Action dated Jan. 10, 2007 for Appl. No. 2,373,164; (16 p.).
Canadian Office Action dated Oct. 12, 2007 for Appl. No. 2,428,165; (2 p.).
Response to Canadian Office Action dated Oct. 12, 2007 for Appl. No. 2,428,165; (16 p.).
EP International Search Report dated Mar. 4, 2002 for Appl PCT/GB01/04940; (3 p.).
EP Communication dated Sep. 19, 2006 for App. No. 01980737.9; (1 p.).
EP Response to EPO Communication dated Sep. 19, 2006 for App. No. 01980737.9; (5).
EP Article 96(2) Communication for Application No. EP04735596.1 dated Feb. 5, 2007 (6 p.).
EP Search Report for for Appl. No. 06024001.7 dated Apr. 16, 2007; (2 p.).
EP Examination Report for Appl. 01980737.9 dated Jun. 15, 2007; (5 p.).
Response to EP Examination Report of Jun. 15, 2007 for Appl. 01980737.9; (12 p.).
EP Exam Report for Appl. No. 06024001.7 dated Dec. 13, 2007; (1 p.).
Response to EP Examination Report for Appl. No. 06024001.7 dated Dec. 13, 2007; (6 p.).
EP Search Report for Appl. EP08000994.7 dated Mar. 28, 2008 (4 p.).
Response to EP Examination Report dated Oct. 30, 2008 with Amended Specification for Appl. 08000994.7 (94 p.).
EP Examination Report dated Oct. 30, 2008 for Appl. 08000994.7; (2 p.).
Response to EP Written Opinion dated Aug. 8, 2008 for Appl. 08000994.7; (10 p.).
EP Examination Report dated Nov. 22, 2007 for Appl. 04735596.1; (3 p.).
Response to Examination Report dated Nov. 22, 2007 for Appl. EP04735596.1 (101 p.).
Response to Examination Report dated Feb. 5, 2007 for Appl. 04735596.1 ; (15 p.).
US Office Action for U.S. Appl. No. 12/541,934 dated Jan. 7, 2010; (5 p.).
Response to US Office Action for U.S. Appl. No. 12/541,934 dated Jan. 7, 2010; (6 p.).
US Office Action for U.S. Appl. No. 10/009,991 dated Feb. 26, 2003; (5 p.).
Response to US Office Action dated Feb. 26, 2003 for U.S. Appl. No. 10/009,991; (7 p.).
Notice of Allowance and Fee(s) Due for U.S. Appl. No. 10/009,991 Notice of Allowance dated May 28, 2003; (5 p.).
Notice of Allowance and Fee(s) Due dated Apr. 26, 2006 for U.S. Appl. No. 10/651,703 (6 p.).
Response to Notice of Allowance dated Apr. 26, 2006 for U.S. Appl. No. 10/651,703; (7 p.).
US Office Action dated Dec. 20, 2005 for U.S. Appl. No. 10/651,703; (5 p).
Response to US Office Action dated Dec. 20, 2005 for U.S. Appl. No. 10/651,703; (13 p.).
IPRP, Search Report and Written Opinion dated Sep. 4, 2001 for Appl. PCT/GB00/01785; (17 p.).
EP Examination Report Dated dated Nov. 10, 2010 for Appl. No. 07842464.5; (3 p.).
PCT International Search Report & Written Opinion for Appl. PCT/US2007/078436 dated Aug. 12, 2008; (9 p.).
PCT International Search Report and Written Opinion for PCT/US2007/084884 dated Jun. 13, 2008 (8 p.).
[online] www.subsea7.com; New Technology to Increase Oil Production Introduced to Subsea Market; dated Jun. 13, 2002; (2 p.).
[online] www.subsea7.com; Multiple Application Re-Injection System; (undated); (2 p.).
Notice of Litigation for U.S. Appl. No. 10/558,593; (77 p.).

US Office Action dated Mar. 18, 2010 for U.S. Appl. No. 10/558,593; (6 p.).
US Office Action dated Feb. 11, 2008 for U.S. Appl. No. 10/558,593; (7 p).
Response to US Office Action dated Feb. 11, 2008 for U.S. Appl. No. 10/558,593; (12 p).
US Office Action dated Jul. 10, 2008 for U.S. Appl. No. 10/558,593; (6 p).
Response to US Office Action dated Jul. 10, 2008 for U.S. Appl. No. 10/558,593; (12 p).
US Office Action dated Jan. 8, 2009 for U.S. Appl. No. 10/558,593; (8 p.).
Response to US Office Action dated Jan. 8, 2009 for U.S. Appl. No. 10/558,593; (31 p.).
US Final Office Action dated Jul. 7, 2009 for U.S. Appl. No. 10/558,593 (6 p.).
Response to US Final Office Action dated Jul. 7, 2009 for U.S. Appl. No. 10/558,593 (26 p.).
US Office Action dated Jul. 21, 2010 for U.S. Appl. No. 10/558,593; (10 p.).
Written Opinion dated Oct. 12, 2010 for Singapore Appl. No. 200903221-0; (11 p.).
AU Examiner's Report dated Sep. 14, 2010 for Appl. No. 2004289864; (2 p.).
EP Exam Report dated May 4, 2010 for Appl. 07864486.1; (3 p.).
EP Exam Report dated May 4, 2010 for Appl. 07864482.0; (3 p.).
EP Exam Report dated Aug. 2, 2010 for Appl. EP10161117.6; (1 p.).
EP Exam Report dated Aug. 2, 2010 for Appl. EP10161116.8; (1 p.).
EP Exam Report dated Aug. 4, 2010 for Appl. EP10161120.0; (1 p.).
Written Opinion for Singapore Appl. 200903220-2 dated May 3, 2010; (5 p.).
Office Action dated Aug. 31, 2010 for U.S. Appl. No. 10/590,563; (13 p.).
US Office Action dated Oct. 6, 2010 for U.S. Appl. No. 12/541,938; (7 p).
US Office Action dated Aug. 12, 2010 for U.S. Appl. No. 12/441,119; (14 p.).
Response to US Office Action dated Aug. 12, 2010 for U.S. Appl. No. 12/441,119; (12 p.).
Response to US Office Action dated Jul. 21, 2010 for U.S. Appl. No. 10/558,593; (9 p.).
PCT International Search Report & Written Opinion dated Aug. 12, 2008 for Appl. PCT/US2007/078436; (9 p.).
PCT International Search Report and Written Opinion dated Jun. 13, 2008 for Appl. PCT/US2007/084879;(9 p.).
EP Examination Report dated Oct. 12, 2010 for Appl 10167182.4; (3 p.).
EP Examination Report dated Oct. 14, 2010 for Appl. 10167181.6; (3 p.).
EP Examination Report dated Oct. 14, 2010 for Appl. 10167184.0; (3 p.).
EP Examination Report dated Oct. 14, 2010 for Appl. 10167183.2; (3 p.).
European Response to Oral Summons dated Sep. 22, 2011; European Application No. 01980737.9 (42 p.).
Office Action dated Oct. 14, 2011 Canadian Application No. 2,526,714 (3 p.).
European Exam Report dated Nov. 14, 2011; European Application No. 05781685.2 (3 p.).
European Decision to Grant dated Nov. 4, 2011; European Application No. 01980737.9 (4 p.).
Supplemental Notice of Allowance dated Oct. 11, 2011; U.S. Appl. No. 12/441,119 (8 p.).
Office Action dated Oct. 17, 2011; U.S. Appl. No. 12/768,337 (64 p.).
Notice of Allowance dated Oct. 17, 2011; U.S. Appl. No. 12/768,332 (56 p.).
Office Action dated Oct. 17, 2011; U.S. Appl. No. 12/768,324 (18 p.).
Corrected Notice of Allowance dated Oct. 26, 2011; U.S. Appl. No. 12/541,938 (8 p.).
Supplemental Notice of Allowability dated Dec. 6, 2011; U.S. Appl. No. 12/768,332 (10 p.).

* cited by examiner

FIG. 1
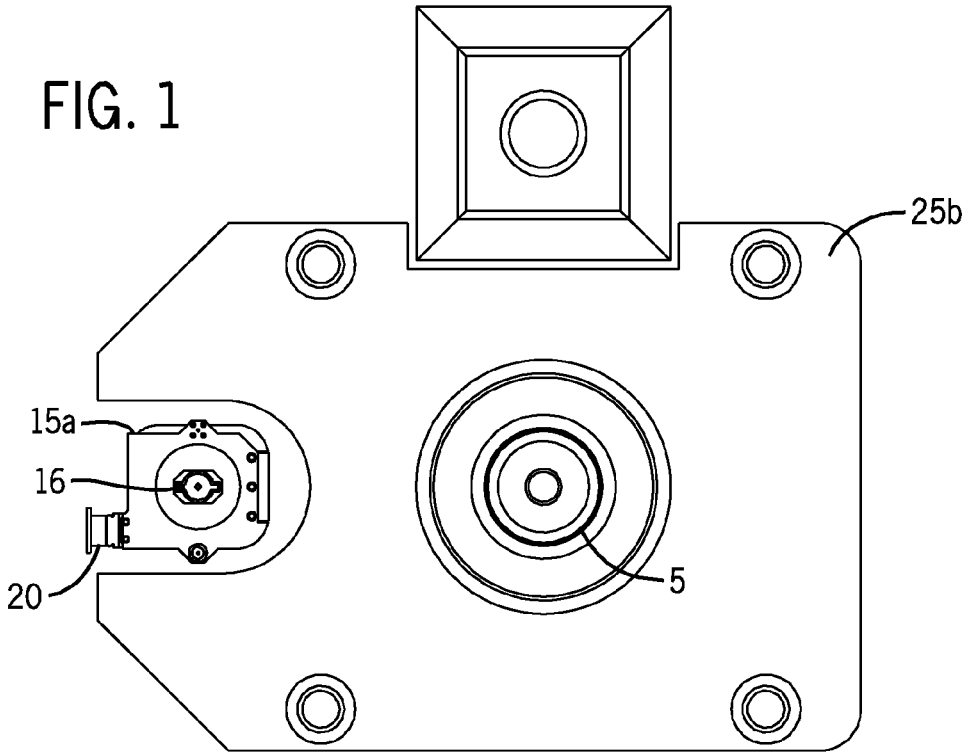
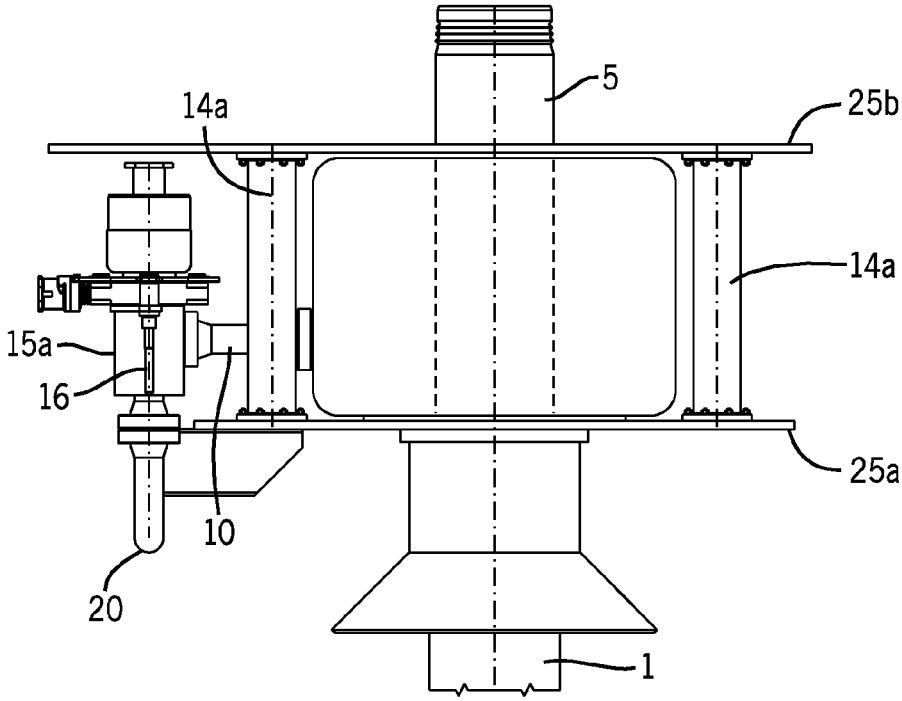
FIG. 2

APPARATUS AND METHOD FOR PROCESSING FLUIDS FROM A WELL

CROSS REFERENCE TO RELATED APPLICATION

This application claims priority to PCT Application No. PCT/US07/84879 entitled "Apparatus and Method for Processing Fluids from a Well", filed on Nov. 15, 2007, which is herein incorporated by reference in its entirety, and which claims priority to Great Britain Provisional Patent Application No. GB0625191.2 entitled "Apparatus and Method for Processing Fluids From A Well", filed on Dec. 18, 2006, which is herein incorporated by reference in its entirety.

Other related applications include U.S. application Ser. No. 10/009,991 filed on Jul. 16, 2002, now U.S. Pat. No. 6,637,514; U.S. application Ser. No. 10/415,156 filed on Apr. 25, 2003, now U.S. Pat. No. 6,823,941; U.S. application Ser. No. 10/651,703 filed on Aug. 29, 2003, now U.S. Pat. No. 7,111,687; U.S. application Ser. No. 10/558,593 filed on Nov. 29, 2005; U.S. application Ser. No. 10/590,563 filed on Dec. 13, 2007; U.S. application Ser. No. 12/441,119 filed on Mar. 12, 2009; U.S. application Ser. No. 12/515,729 filed on May 20, 2009; U.S. application Ser. No. 12/541,934 filed on Aug. 15, 2009; U.S. application Ser. No. 12/541,936 filed on Aug. 15, 2009; U.S. application Ser. No. 12/541,937 filed on Aug. 15, 2009; U.S. application Ser. No. 12/541,938 filed on Aug. 15, 2009; U.S. application Ser. No. 12/768,324 filed on Apr. 27, 2010; U.S. application Ser. No. 12/768,332 filed on Apr. 27, 2010; and U.S. application Ser. No. 12/768,337 filed on Apr. 27, 2010.

FIELD OF THE INVENTION

The present invention relates to apparatus and methods for Processing well fluids. Some embodiments of the invention can be used for Recovery and injection of well fluids. Some embodiments relate especially but Not exclusively to recovery and injection, into either the same, or a different Well.

BACKGROUND

This section is intended to introduce the reader to various aspects of art that may be related to various aspects of the present invention, which are described and/or claimed below. This discussion is believed to be helpful in providing the reader with background information to facilitate a better understanding of the various aspects of the present invention. Accordingly, it should be understood that these statements are to be read in this light, and not as admissions of prior art.

As will be appreciated, oil and natural gas have a profound effect on modern economies and societies. In order to meet the demand for such natural resources, numerous companies invest significant amounts of time and money in searching for and extracting oil, natural gas, and other subterranean resources from the earth. Particularly, once a desired resource is discovered below the surface of the earth, drilling and production systems are employed to access and extract the resource. These systems can be located onshore or offshore depending on the location of a desired resource. Further, such systems generally include a wellhead assembly through which the resource is extracted. These wellhead assemblies generally include a wide variety of components and/or conduits, such as a christmas tree (tree), various control lines, casings, valves, and the like, that control drilling and/or extraction operations.

Subsea manifolds such as trees (sometimes called christmas trees) are well known in the art of oil and gas wells, and generally comprise an assembly of pipes, valves and fittings installed in a wellhead after completion of drilling and installation of the production tubing to control the flow of oil and gas from the well. Subsea trees typically have at least two bores one of which communicates with the production tubing (the production bore), and the other of which communicates with the annulus (the annulus bore).

Typical designs of conventional trees have a side outlet (a production wing branch) to the production bore closed by a production wing valve for removal of production fluids from the production bore. The annulus bore also typically has an annulus wing branch with a respective annulus wing valve. The top of the production bore and the top of the annulus bore are usually capped by a tree cap which typically seals off the various bores in the tree, and provides hydraulic channels for operation of the various valves in the tree by means of intervention equipment, or remotely from an offshore installation.

Wells and trees are often active for a long time, and wells from a decade ago may still be in use today. However, technology has progressed a great deal during this time, for example, subsea processing of fluids is now desirable. Such processing can involve adding chemicals, separating water and sand from the hydrocarbons, etc.

Conventional treatment methods involve conveying the fluids over long distances for remote treatment, and some methods and apparatus include localized treatment of well fluids, by using pumps to boost the flow rates of the well fluids, chemical dosing apparatus, flow meters and other types of treatment apparatus.

One problem with locating the treatment apparatus locally on the tree is that the treatment apparatus can be bulky and can obstruct the bore of the well. Therefore, intervention operations requiring access to the wellbore can require removal of the treatment apparatus before access to the well can be gained.

SUMMARY OF THE INVENTION

According to a first aspect of the present invention there is provided an apparatus for the processing of fluids flowing in a manifold of an oil or gas well, the apparatus comprising a processing device, wherein the processing device is arranged in a processing module located at the manifold, wherein the manifold has a wellbore, and wherein the processing device is spaced from the area of the processing module adjacent to the wellbore. Arranging the processing device so that it is spaced from the area of the processing module adjacent to the wellbore permits access to the wellbore without removing or adjusting the processing module. Typically the apparatus is modular and the wellbore extends at least part of the way through the module, and typically extends through a central axis of the apparatus, and the processing device is arranged around the central axis, spaced from the wellbore.

The apparatus can be built in modules, with a first part of the module, for example, a lower surface, being adapted to attach to an interface of a manifold such as a tree, and a second part, for example an upper surface, being adapted to attach to a further module. The second part (e.g. the upper surface) can typically be arranged in the same manner as the manifold interface, so that further modules can be attached to the first module, which typically has at least some of the same connections and footprint of the manifold interface. Thus, modules adapted to connect to the manifold interface in the same manner as the first module can connect instead to the first or to subsequent modules in the same manner, allowing stacking of separate modules on the manifold, each one connecting to the module below as if it were connecting to the manifold interface.

Typically each module has an aperture arranged to align with the aperture on the module below it, to enable access to the wellbore from the top of the uppermost module. Thus the apparatus typically has a wellbore access tunnel extending through the processing modules to enable access to the wellbore without removing or moving the processing modules stacked on the manifold.

The wellbore access tunnel is typically straight and is aligned with the wellbore, although some embodiments of the invention incorporate versions in which the wellbore access tunnel is deviated from the axis of the wellbore itself. Embodiments with straight tunnels in axial alignment with the wellbore have the advantage that the wellbore can be accessed in a straight line, and plugs or other items in the wellbore, perhaps below the tree, can be pulled through the modules via the access tunnel without removing or adjusting the modules. Embodiments in which the wellbore access tunnel is deviated from the axis of the wellbore tend to be more compact and adaptable to large pieces of processing equipment. The wellbore can be the production bore, or a production flowline.

The upper surface of the module will typically have fluid and/or power conduit connectors in the same locations as the respective connectors are disposed in the lower surface, but typically, the upper surface connectors will be adapted to mate with the lower surface connectors, so that the upper surface connectors can mate with the lower surface connectors on the lower surface of the module above. Therefore, where the upper surface has a male connector, the lower surface can typically have a female connector, or vice versa. Typically the module can have support structures such as posts that are adapted to transfer loads across the module to the hard points on the manifold. In certain embodiments, the weight of the processing modules can be borne by the wellbore mandrel.

In some embodiments, the processing device can connect directly into the wellbore mandrel. For example, conduits connecting directly to the mandrel can route fluids to be processed to the processing device. The processing device can optionally connect to a branch of the manifold, typically to a wing branch on a tree. The processing device can typically have an inlet that draws production fluids from a diverter insert located in a choke conduit of the branch of the manifold, and can return the fluids to the diverter insert via an outlet, after processing.

The diverter insert can have a flow diverter to divide the choke conduit into two separate fluid flowpaths within the choke conduit, for example the choke body, and the flow diverter can be arranged to control the flow of fluids through the choke body so that the fluids from the well to be processed are diverted through one flowpath and are recovered through another, for transfer to a flowline, or optionally back into the well. Optionally the flow diverter has a separator to divide the branch bore into two separate regions.

The oil or gas well is typically a subsea well but the invention is equally applicable to topside wells. The manifold may be a gathering manifold at the junction of several flow lines carrying production fluids from, or conveying injection fluids to, a number of different wells. Alternatively, the manifold may be dedicated to a single well; for example, the manifold may comprise a christmas tree.

By "branch" we mean any branch of the manifold, other than a production bore of a tree. The wing branch is typically a lateral branch of the tree, and can be a production or an annulus wing branch connected to a production bore or an annulus bore respectively.

Optionally, the flow diverter is attached to a choke body. "Choke body" can mean the housing which remains after the manifold's standard choke has been removed. The choke may be a choke of a tree, or a choke of any other kind of manifold.

The flow diverter could be located in a branch of the manifold (or a branch extension) in series with a choke. For example, in an embodiment where the manifold comprises a tree, the flow diverter could be located between the choke and the production wing valve or between the choke and the branch outlet. Further alternative embodiments could have the flow diverter located in pipework coupled to the manifold, instead of within the manifold itself. Such embodiments allow the flow diverter to be used in addition to a choke, instead of replacing the choke.

Embodiments where the flow diverter is adapted to connect to a branch of a tree means that the tree cap does not have to be removed to fit the flow diverter. Embodiments of the invention can be easily retro-fitted to existing trees. Preferably, the flow diverter is locatable within a bore in the branch of the manifold. Optionally, an internal passage of the flow diverter is in communication with the interior of the choke body, or other part of the manifold branch.

The invention provides the advantage that fluids can be diverted from their usual path between the well bore and the outlet of the wing branch. The fluids may be produced fluids being recovered and traveling from the well bore to the outlet of a tree. Alternatively, the fluids may be injection fluids traveling in the reverse direction into the well bore. As the choke is standard equipment, there are well-known and safe techniques of removing and replacing the choke as it wears out. The same tried and tested techniques can be used to remove the choke from the choke body and to clamp the flow diverter onto the choke body, without the risk of leaking well fluids into the ocean. This enables new pipework to be connected to the choke body and hence enables safe re-routing of the produced fluids, without having to undertake the considerable risk of disconnecting and reconnecting any of the existing pipes (e.g. the outlet header). Some embodiments allow fluid communication between the well bore and the flow diverter. Other embodiments allow the wellbore to be separated from a region of the flow diverter. The choke body may be a production choke body or an annulus choke body.

Preferably, a first end of the flow diverter is provided with a clamp for attachment to a choke body or other part of the manifold branch. Optionally, the flow diverter has a housing that is cylindrical and typically the internal passage extends axially through the housing between opposite ends of the housing. Alternatively, one end of the internal passage is in a side of the housing.

Typically, the flow diverter includes separation means to provide two separate regions within the flow diverter. Typically, each of these regions has a respective inlet and outlet so that fluid can flow through both of these regions independently. Optionally, the housing includes an axial insert portion.

Typically, the axial insert portion is in the form of a conduit. Typically, the end of the conduit extends beyond the end of the housing. Preferably, the conduit divides the internal passage into a first region comprising the bore of the conduit and a second region comprising the annulus between the housing and the conduit. Optionally, the conduit is adapted to seal within the inside of the branch (e.g. inside the choke body) to prevent fluid communication between the annulus and the bore of the conduit.

Alternatively, the axial insert portion is in the form of a stem. Optionally, the axial insert portion is provided with a plug adapted to block an outlet of the christmas tree, or other kind of manifold. Preferably, the plug is adapted to fit within and seal inside a passage leading to an outlet of a branch of the manifold. Optionally, the diverter assembly provides means for diverting fluids from a first portion of a first flowpath to a second flowpath, and means for diverting the fluids from a second flowpath to a second portion of a first flowpath. Preferably, at least a part of the first flowpath comprises a branch of the manifold. The first and second portions of the first flowpath could comprise the bore and the annulus of a conduit.

The diverter insert is optional and in certain embodiments the processing device can take fluids from a bore of the well and return them to the same or a different bore, or to a branch, without involving a flow diverter having more than one flowpath. For example, the fluids could be taken through a plain single bore conduit from one hub on a tree into the processing apparatus, and back into a second hub on the same or a different tree, through a plain single bore conduit.

According to a second aspect of the present invention there is provided a manifold having apparatus according to the first aspect of the invention. Typically, the processing device is chosen from at least one of: a pump; a process fluid turbine; injection apparatus for injecting gas or steam; chemical injection apparatus; a chemical reaction vessel; pressure regulation apparatus; a fluid riser; measurement apparatus; temperature measurement apparatus; flow rate measurement apparatus; constitution measurement apparatus; consistency measurement apparatus; gas separation apparatus; water separation apparatus; solids separation apparatus; and hydrocarbon separation apparatus.

Optionally, the flow diverter provides a barrier to separate a branch outlet from a branch inlet. The barrier may separate a branch outlet from a production bore of a tree. Optionally, the barrier comprises a plug, which is typically located inside the choke body (or other part of the manifold branch) to block the branch outlet. Optionally, the plug is attached to the housing by a stem which extends axially through the internal passage of the housing.

Alternatively, the barrier comprises a conduit of the diverter assembly which is engaged within the choke body or other part of the branch. Optionally, the manifold is provided with a conduit connecting the first and second regions. Optionally, a first set of fluids are recovered from a first well via a first diverter assembly and combined with other fluids in a communal conduit, and the combined fluids are then diverted into an export line via a second diverter assembly connected to a second well.

According to a fourth aspect of the present invention, there is provided a method of processing wellbore fluids, the method comprising the steps of: connecting a processing apparatus to a manifold, wherein the processing apparatus has a processing device and a wellbore access tunnel; diverting the fluids from a first part of the wellbore of the manifold to the processing device; processing the fluids in the processing device; and returning the processed fluids to a second part of the wellbore of the manifold.

Typically, the method is for recovering fluids from a well, and includes the final step of diverting fluids to an outlet of the first flowpath for recovery therefrom. Alternatively or additionally, the method is for injecting fluids into a well. The fluids may be passed in either direction through the diverter assembly.

BRIEF DESCRIPTION OF THE DRAWINGS

Various features, aspects, and advantages of the present invention will become better understood when the following detailed description is read with reference to the accompanying figures in which like characters represent like parts throughout the figures, wherein:

FIG. 1 is a plan view of a typical horizontal production tree;

FIG. 2 is a side view of the FIG. 1 tree;

DETAILED DESCRIPTION OF SPECIFIC EMBODIMENTS

Figure 3:
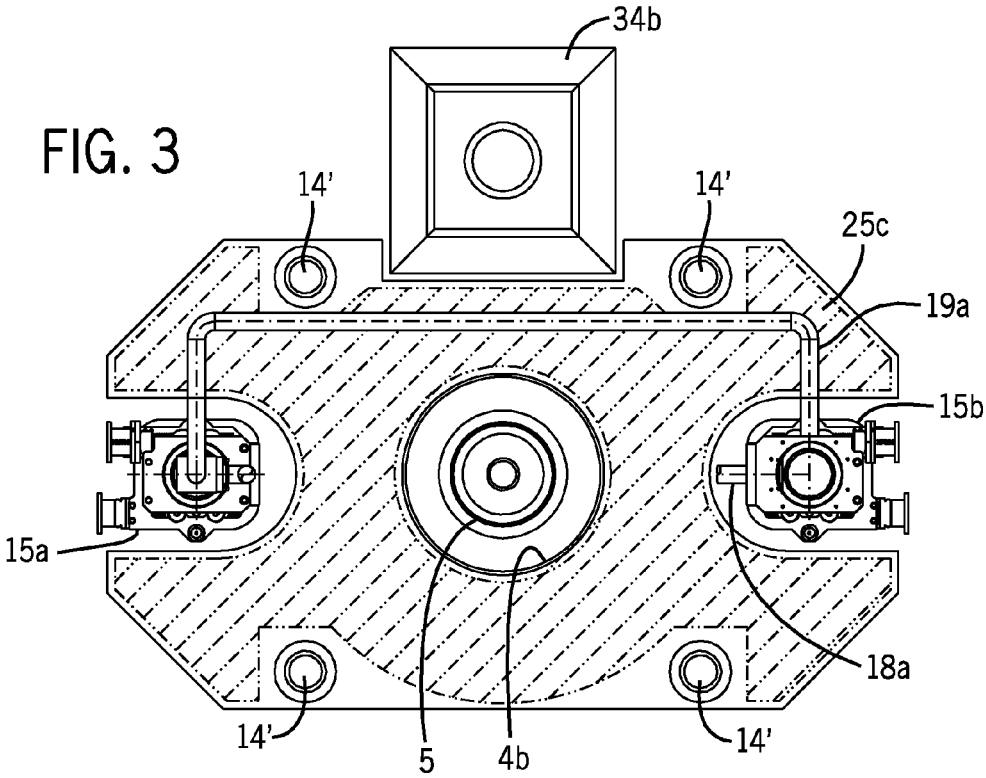
FIG. 3 is a plan view of FIG. 1 tree with a first fluid processing module in place.

One or more specific embodiments of the present invention will be described below. These described embodiments are only exemplary of the present invention. Additionally, in an effort to provide a concise description of these exemplary embodiments, all features of an actual implementation may not be described in the specification. It should be appreciated that in the development of any such actual implementation, as in any engineering or design project, numerous implementation-specific decisions must be made to achieve the developers' specific goals, such as compliance with system-related and business-related constraints, which may vary from one implementation to another. Moreover, it should be appreciated that such a development effort might be complex and time consuming, but would nevertheless be a routine undertaking of design, fabrication, and manufacture for those of ordinary skill having the benefit of this disclosure.

Referring now to the drawings, a typical production manifold on an offshore oil or gas wellhead comprises a christmas tree with a production bore 1 leading from production tubing (not shown) and carrying production fluids from a perforated region of the production casing in a reservoir (not shown). An annulus bore 2 (see FIG. 7) leads to the annulus between the casing and the production tubing. A tree cap typically seals off the production bore 1, and provides a number of hydraulic control channels by which a remote platform or intervention vessel can communicate with and operate valves in the christmas tree. The cap is removable from the christmas tree in order to expose the production bore in the event that intervention is required and tools need to be inserted into the wellbore. In the horizontal trees shown in the drawings, a large diameter production bore 1 is provided to feed production fluids directly to a production wing branch 10 from which they are recovered. Embodiments of the invention are equally applicable to other types of trees, for example horizontal tree, and to other kinds of manifolds other than trees.

Figure 7:
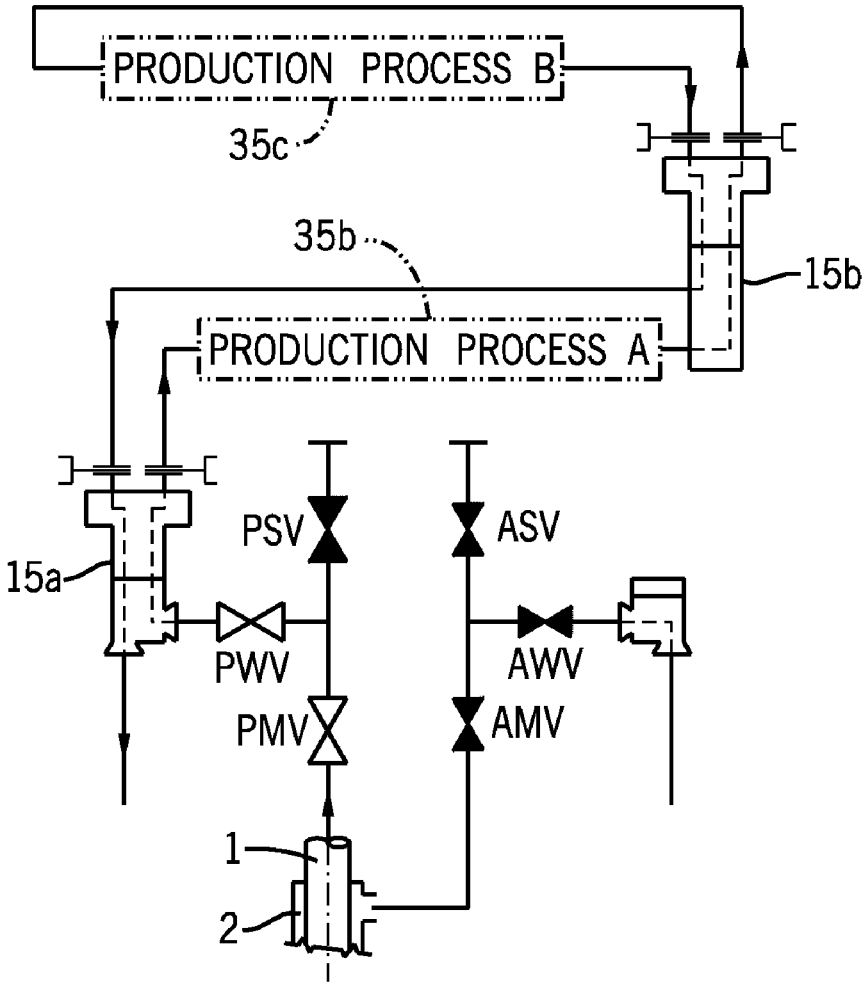
FIG. 7 is a schematic diagram showing the flowpaths of the FIG. 6 arrangement.

The flow of fluids through the production and annulus bores is governed by various valves shown in the schematic arrangement of FIG. 7. The production bore 1 has a branch 10 which is closed by a production wing valve PWV. A production swab valve PSV closes the production bore 1 above the branch 10, and a production master valve PMV closes the production bore 1 below the branch 10.

The annulus bore 2 is closed by an annulus master valve AMV below an annulus outlet controlled by an annulus wing valve AWV. An annulus swab valve ASV closes the upper end of the annulus bore 2.

All valves in the tree are typically hydraulically controlled by means of hydraulic control channels passing through the cap and the body of the apparatus or via hoses as required, in response to signals generated from the surface or from an intervention vessel.

When production fluids are to be recovered from the production bore 1, PMV is opened, PSV is closed, and PWV is opened to open the branch 10 which leads to a production flowline or pipeline 20. PSV and ASV are generally only opened if intervention is required.

The wing branch 10 has a choke body 15*a* in which a production choke 16 is disposed, to control the flow of fluids through the choke body and out through production flowline 20.

The manifold on the production bore 1 typically comprises a first plate 25*a* and a second plate 25*b* spaced apart in vertical relationship to one another by support posts 14*a*, so that the second plate 25*b* is supported by the posts 14*a* directly above the first plate 25*a*. The space between the first plate 25*a* and the second plate 25*b* is occupied by the fluid conduits of the wing branch 10, and by the choke body 15. The choke body 15*a* is usually mounted on the first plate 25*a*, and above it, the second plate 25*b* will usually have a cut-out section to facilitate access to the choke 16 in use.

The first plate 25*a* and the second plate 25*b* each have central apertures that are axially aligned with one another and with the production bore 1 for allowing passage of the central mandrel 5 of the wellbore, which protrudes between the plates 25 and extends through the upper surface of the second plate to permit access to the wellbore from above the wellhead for intervention purposes. The upper end of the central mandrel is optionally capped with the tree cap or a debris cover (removed in drawings) to seal off the wellbore in normal operation.

Figure 4:
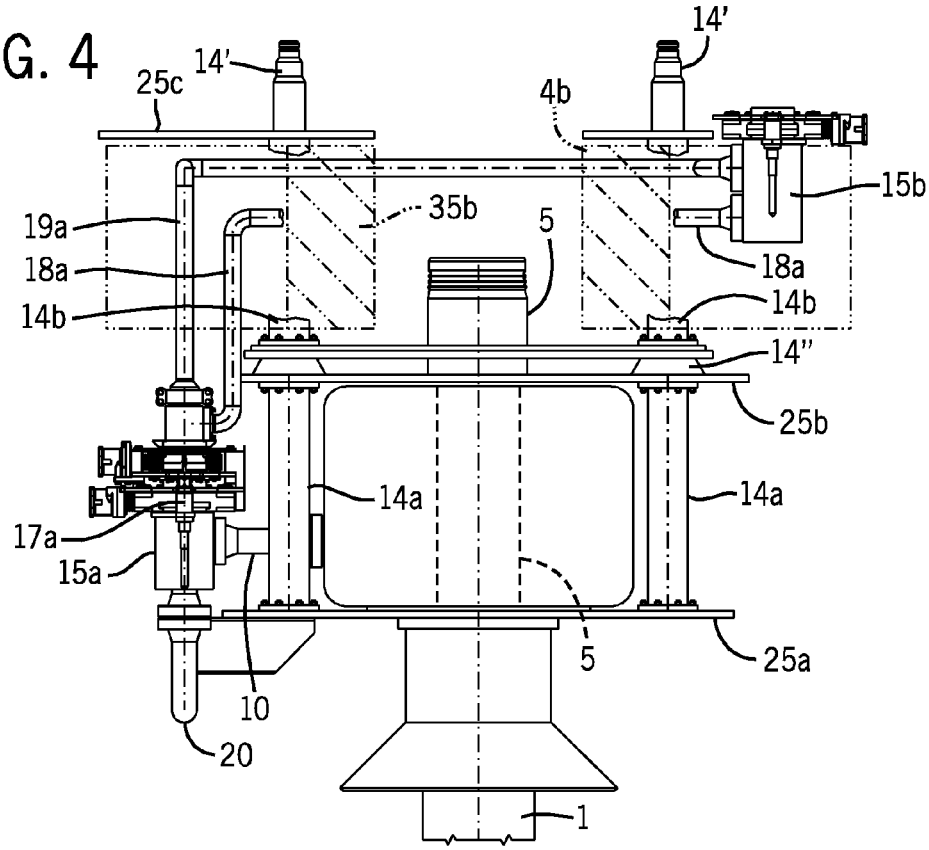
FIG. 4 is a side view of the FIG. 3 arrangement.

Referring now to FIGS. 3 and 4, the conventional choke 16 has been removed from the choke body 15*a*, and has been replaced by a fluid diverter that takes fluids from the wing branch 10 and diverts them through an annulus of the choke body to a conduit 18*a* that feeds them to a first processing module 35*b*. The second plate 25*b* can optionally act as a platform for mounting the first processing module 35*b*. A second set of posts 14*b* are mounted on the second plate 25*b* directly above the first set of posts 14*a*, and the second posts 14*b* support a third plate 25*c* above the second plate 25*b* in the same manner as the first posts 14*a* support the second plate 25*b* above the first plate 25*a*. Optionally, the first processing module 35*b* disposed on the second plate 25*b* has a base that rests on feet set directly in line with the posts 14 in order to transfer loads efficiently to the hard points of the tree. Optionally, loads can be routed through the mandrel of the wellbore, and the posts and feet can be omitted.

The first processing module contains a processing device for processing the production fluids from the wing branch 10. Many different types of processing devices could be used here. For example, the processing device could comprise a pump or process fluid turbine, for boosting the pressure of the production fluids. Alternatively, or additionally, the processing apparatus could inject gas, steam, sea water, or other material into the fluids. The fluids pass from the conduit 18*a* into the first processing module 35*b* and after treatment or processing, they are passed through a second choke body 15*b* which is blanked off with a cap, and which returns the processed production fluids to the first choke body 15*a* via return conduit 19*a*. The processed production fluids pass through the central axial conduit of the fluid diverter in the choke body 15*a*, and leave it via the production flowpath 20. After the processed fluids have left the choke body 15*a*, they can be recovered through a normal pipeline back to surface, or reinjected into a well, or can be handled or further processed in any other way desirable. The injection of gas could be advantageous, as it would give the fluids "lift". The addition of steam has the effect of adding energy to the fluids.

Injecting sea water into a well could be useful to boost the formation pressure for recovery of hydrocarbons from the well, and to maintain the pressure in the underground formation against collapse. Also, injecting waste gases or drill cuttings etc into a well obviates the need to dispose of these at the surface, which can prove expensive and environmentally damaging.

The processing device could also enable chemicals to be added to the fluids, e.g. viscosity moderators, which thin out the fluids, making them easier to pump, or pipe skin friction moderators, which minimize the friction between the fluids and the pipes. Further examples of chemicals which could be injected are surfactants, refrigerants, and well fracturing chemicals. Processing device could also comprise injection water electrolysis equipment. The chemicals/injected materials could be added via one or more additional input conduits. The processing device could also comprise a fluid riser, which could provide an alternative route between the well bore and the surface. This could be very useful if, for example, the branch 10 becomes blocked. Alternatively, the processing device could comprise separation equipment e.g. for separating gas, water, sand/debris and/or hydrocarbons. The separated component(s) could be siphoned off via one or more additional processes. The processing device could alternatively or additionally include measurement apparatus, e.g. for measuring the temperature/flow rate/constitution/consistency, etc. The temperature could then be compared to temperature readings taken from the bottom of the well to calculate the temperature change in produced fluids. Furthermore, the processing device could include injection water electrolysis equipment. Alternative embodiments of the invention can be used for both recovery of production fluids and injection of fluids, and the type of processing apparatus can be selected as appropriate.

A suitable fluid diverter for use in the choke body 15*a* in the FIG. 4 embodiment is described in application WO/2005/047646, the disclosure of which is incorporated herein by reference.

The processing device(s) is built into the shaded areas of the processing module 35*b* as shown in the plan view of FIG. 3, and a central axial area is clear from processing devices, and defines a wellbore access tunnel 4*b*. At its lower end near to the second plate 25*b*, the wellbore access tunnel 4*b* receives the upper end of the wellbore mandrel 5 that extends through the upper surface of the second plate 25*b* as shown in FIG. 2.

The upper surface of the third plate 25*c* has a very similar profile to the basic tree shown in FIG. 1. The features of the upper surface of the third plate 35*c* are arranged as they are on the basic tree, for example, the hard points for weight bearing are provided by the posts 14, and any fluid connections that may be required (for example hydraulic signal conduits at the upper face of the second plate 25*b* that are needed to operate instruments on the tree) can have continuous conduits that provide an interface between the third plate 25*c* and the second plate 25*b*.

The third plate 25*c* has a cut out section to allow access to the second choke body 15*b*, but this can be spaced apart from the first choke body 15*a*, and does not need to be directly above.

The guide posts 14 can optionally be arranged as stab posts 14' extending upward from the upper surface of the plates, and mating with downwardly-facing sockets 14" on the base of the processing module above them, as shown in FIG. 4. In either event, it is advantageous (but not essential) that the support posts on a lower module are directly beneath those on an upper module, to enhance the weight bearing characteristics of the apparatus. A control panel 34*b* can be provided for the control of the processing module 35*b*. In the example shown in FIG. 4, the processing module comprises a pump.

Figure 5:
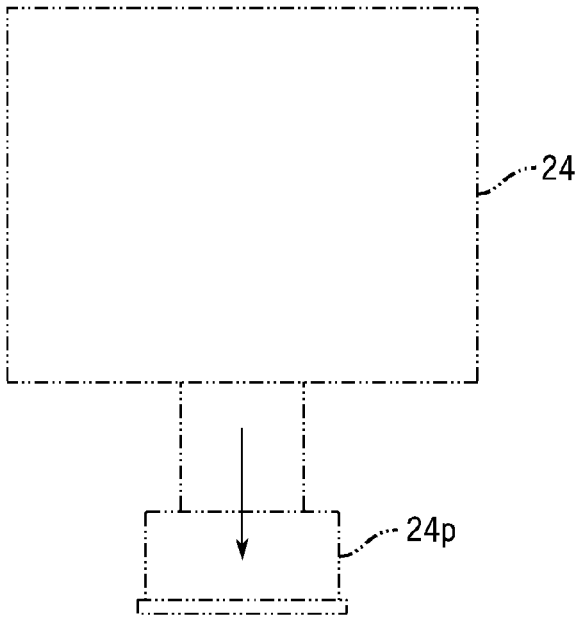
FIG. 5 is a side view of the FIG. 3 arrangement with a workover tool being lowered into position over the tree.
Figure 5:
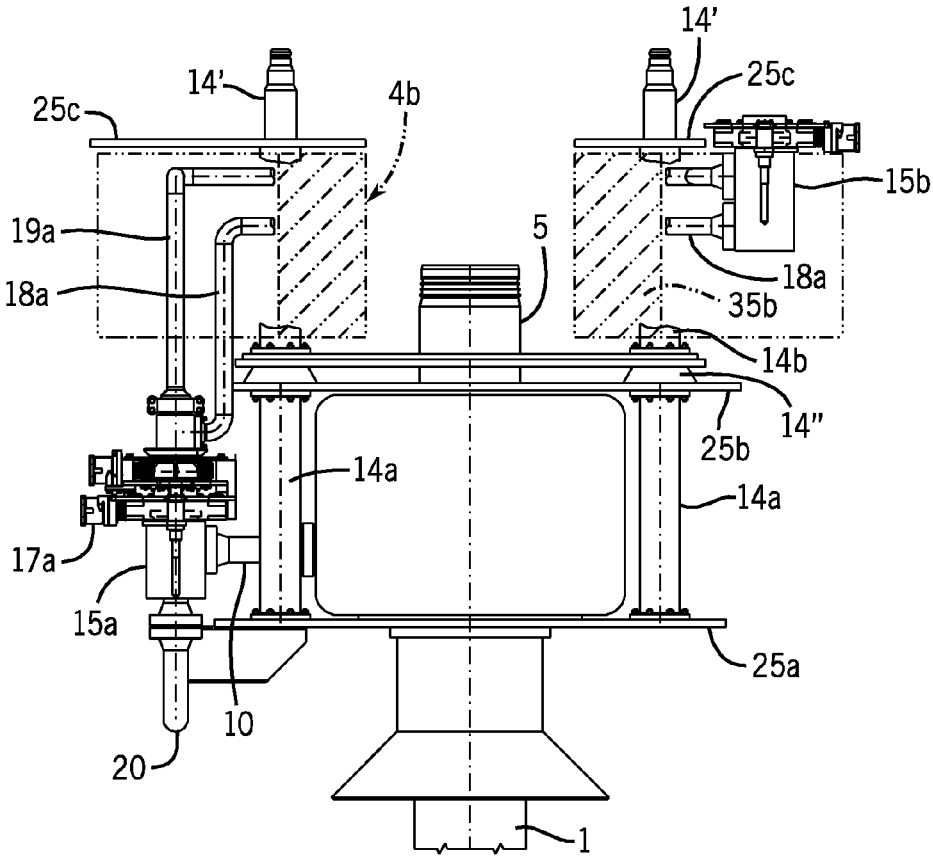

Referring now to FIG. 5, a workover tool 24 can be lowered from surface to perform various tasks on the manifold, such as pulling and replacing plugs in the wellbore 1. Access to the wellbore from the top of the processing modules can be provided through the wellbore access tunnel 4*b*. The workover tool 24 is lowered with a wellbore mating projection 24*p* extending downwards from the workover tool 24 in order to mate with the wellbore, and perform the workover procedures. A socket on the lower end terminus of the workover projection 24*p* has connection devices to seal the projection 24*p* to the mandrel 5, and the socket is stepped at the inner surface of the projection 24*p*, so that the inner bore of the mandrel 5 is continuous with the inner bore of the projection 24*p* and is sealed thereto. When the projection 24*p* is connected to the mandrel 5, it effectively extends the bore of the mandrel 5 upwards through the upper surface of the third plate 25*c* and permits workover procedures in the wellbore without compromising wellbore pressure integrity or continuity.

Optionally the workover tool 24 can be adapted to land on the posts 14' on the upper surface of the processing module and can have sockets etc for securing the connection and ensuring that the weight of the workover tool 24 is borne on the hard points of the manifold directly underneath the posts 14.

Figure 6:
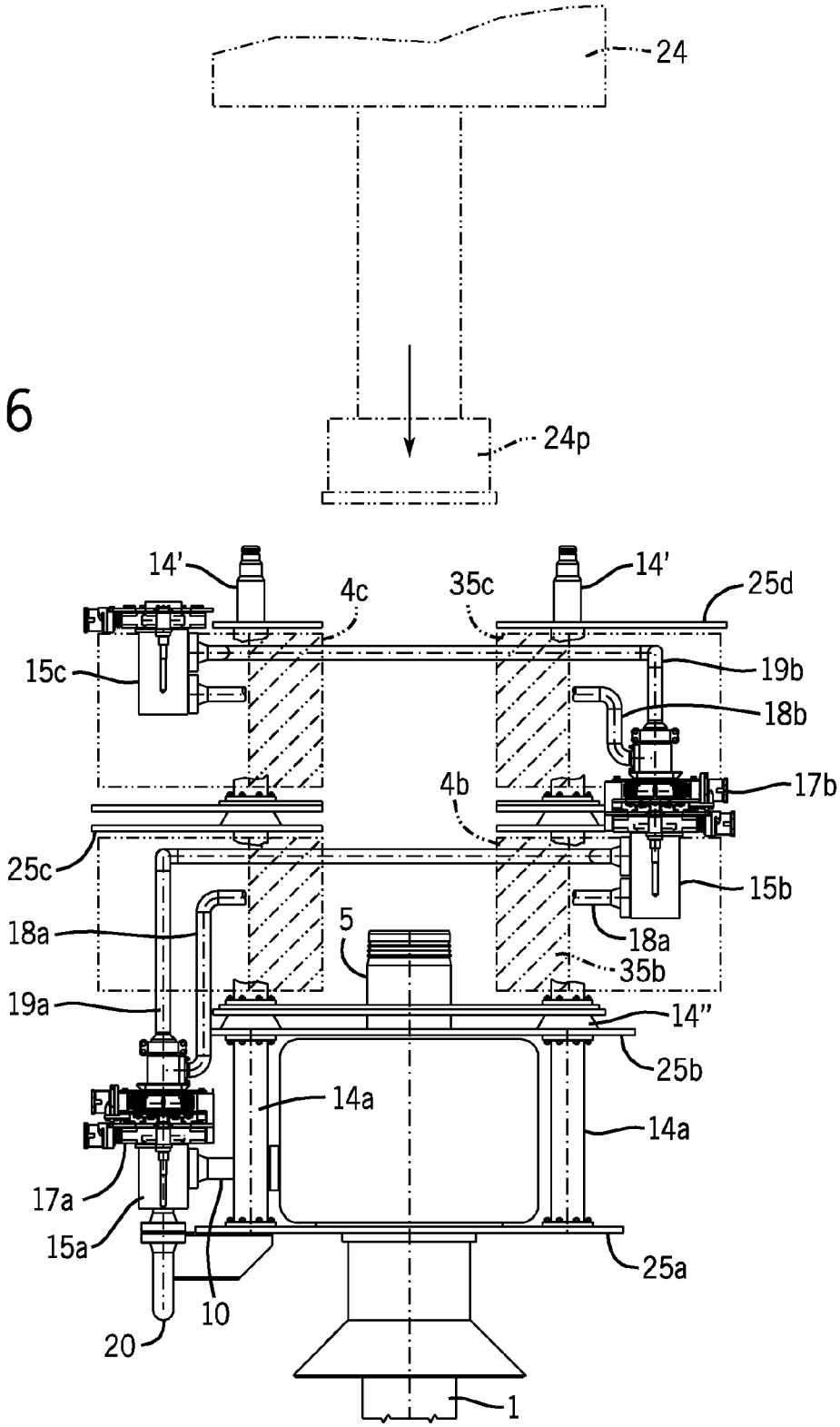
FIG. 6 is a side view of the FIG. 3 arrangement with a further fluid processing module in place, and with a workover tool being lowered into position over the tree.

Referring now to FIG. 6, a second processing module 35*c* has been installed on the upper surface of the third plate 25*c*. The blank cap in the second choke body 15*b* has been replaced with a fluid diverter 17*b* similar to the diverter now occupying the first choke body 15*a*. The diverter 17*b* is provided with fluid conduits 18*b* and 19*b* to send fluids to the second processing module 35*c* and to return them therefrom, via a further blanked choke body 15*c*, for transfer back to the first choke body 15*a*, and further treatment, recovery or injection as previously described.

Above the second processing module 35*c* is a fourth plate 25*d*, which has the same footprint as the second and third plates, with guide posts 14" and fluid connectors etc in the same locations. The second processing module, which may incorporate a different processing device from the first module, for example a chemical dosing device, is also built around a second wellbore access tunnel 4*c*, which is axially aligned with the mandrel bore 5 and the first wellbore access tunnel 4*b*. Thus the aperture for wellbore access effectively extends continuously through the two processing units and has the same top profile as the basic wellhead, thereby facilitating intervention using equipment such as the workover tool 24 without having to remove the processing units. Processing units can be arranged in parallel or in series.

Figure 8:
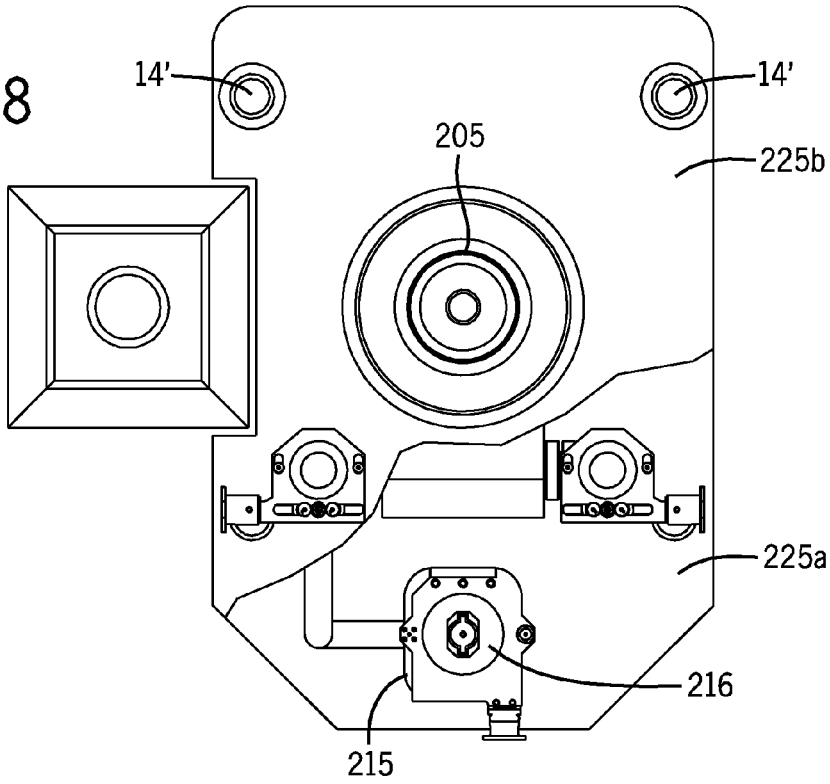
FIG. 8 shows a plan view of a further design of wellhead.
Figure 9:
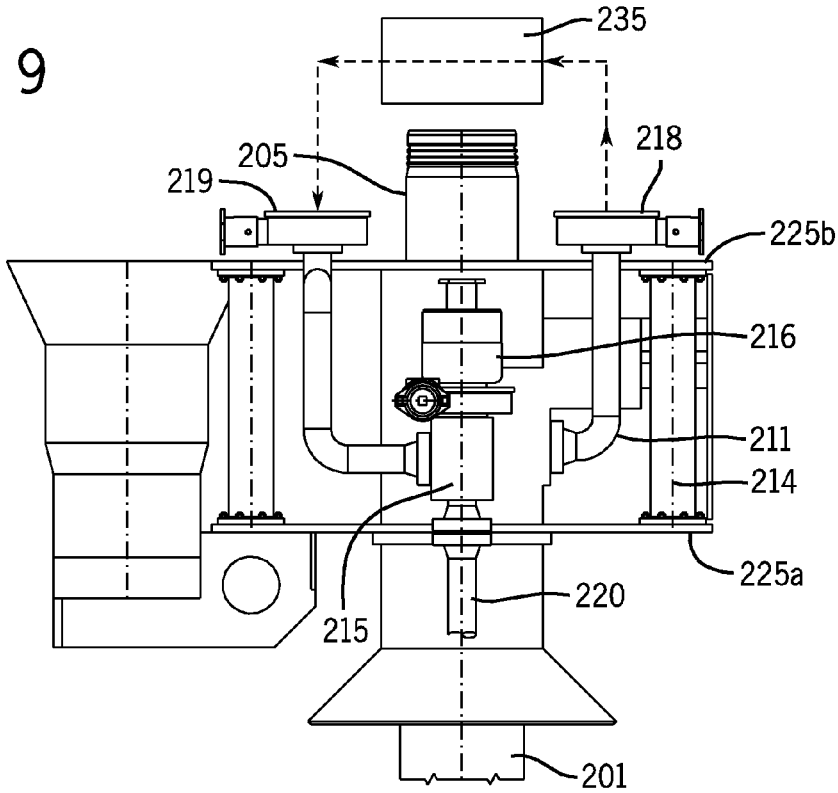
FIG. 9 shows a side view of the FIG. 8 wellhead, with a processing module.
Figure 10:
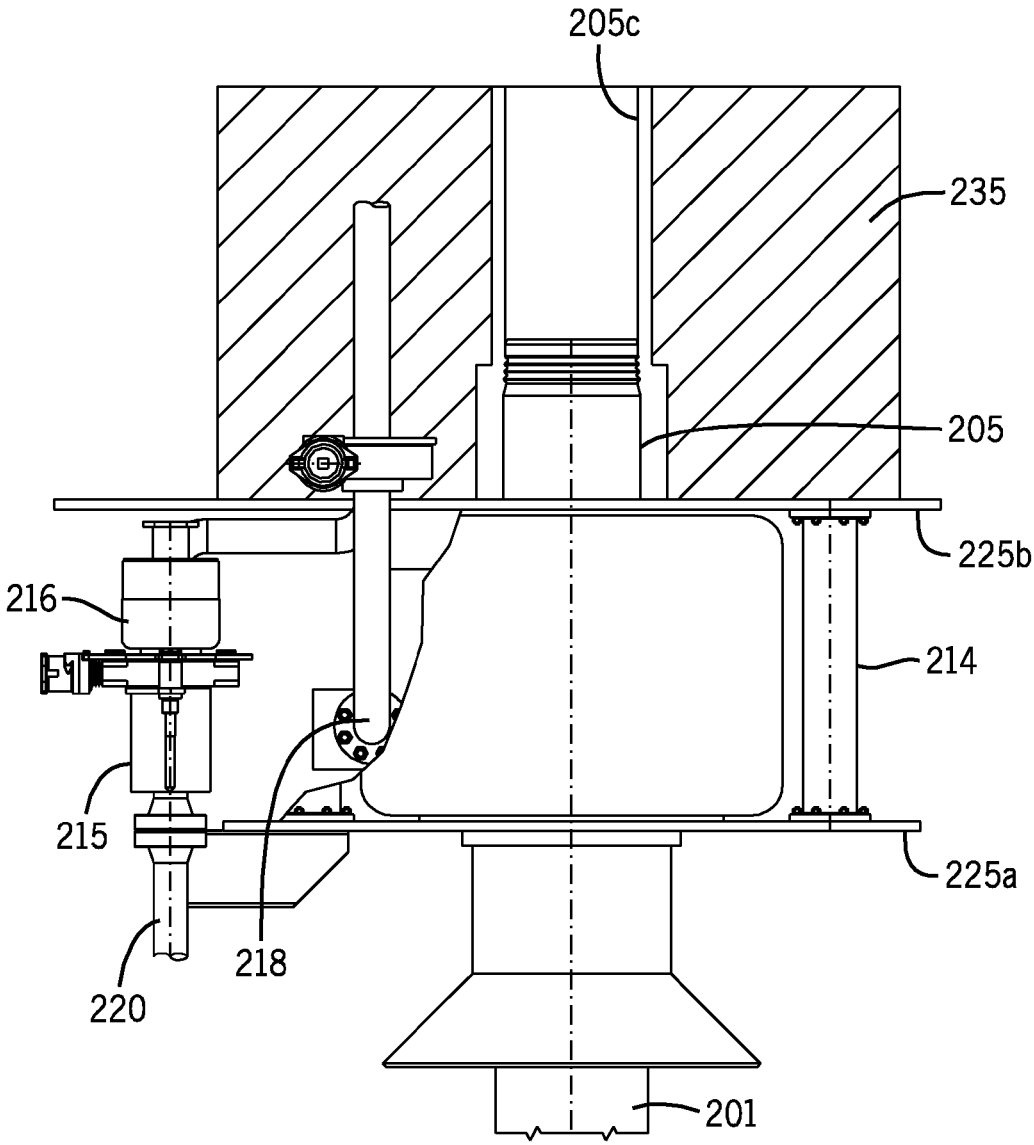
FIG. 10 shows a front facing view of the FIG. 11 wellhead.

FIGS. 8-10 show an alternative embodiment, in which the wellhead has stacked processing modules as previously described, but in which the specialized dual bore diverter 17 insert in the choke body 15 has been replaced by a single bore jumper system. In the modified embodiment shown in these FIGS., the same numbering has been used, but with 200 added to the reference numbers. The production fluids rise up through the production bore 201, and pass through the wing branch but instead of passing from there to the choke body 215, they are diverted into a single bore jumper bypass 218 and pass from there to the process module 235. After being processed, the fluids flow from the process module 235 through a single bore return line 219 to the choke body 215, where they pass through the conventional choke 216 and leave through the choke body outlet 220. This embodiment illustrates the application of the invention to manifolds without dual bore concentric flow diverters in the choke bodies.

Embodiments of the invention provide intervention access to trees or other manifolds with treatment modules in the same way as one would access trees or other manifolds that have no such treatment modules. The upper surfaces of the topmost module of embodiments of the invention are arranged to have the same footprint as the basic tree or manifold, so that intervention equipment can land on top of the modules, and connect directly to the bore of the manifold without spending any time removing or re-arranging the modules, thereby saving time and costs.

Modifications and improvements may be incorporated without departing from the scope of the invention. For example the assembly could be attached to an annulus bore, instead of to a production bore. Any of the embodiments which are shown connected to a production wing branch could instead be connected to an annulus wing branch, or another branch of the tree, or to another manifold. Certain embodiments could be connected to other parts of the wing branch, and are not necessarily attached to a choke body. For example, these embodiments could be located in series with a choke, at a different point in the wing branch.

While the invention may be susceptible to various modifications and alternative forms, specific embodiments have been shown by way of example in the drawings and have been described in detail herein. However, it should be understood that the invention is not intended to be limited to the particular forms disclosed. Rather, the invention is to cover all modifications, equivalents, and alternatives falling within the spirit and scope of the invention as defined by the following appended claims.

The invention claimed is:

1. A system, comprising:

a first module configured to process fluid from a well, wherein the first module comprises:

a processing device coupleable to a tree manifold;

a first access tunnel extending through the processing device, wherein the access tunnel is configured to receive a tool inside the first access tunnel and provide access for the tool to mate with the tree manifold;

a processing input; and a processing output.

2. The system of claim 1, wherein the first access tunnel is configured to align with a mandrel of the manifold and the tool has a common diameter bore with the mandrel.

3. The system of claim 1, wherein the first access tunnel is configured to provide access to a bore of the manifold and tool has a common diameter bore with the tree manifold bore.

4. The system of claim 1, wherein the first access tunnel is defined by a region void of the processing device.

5. The system of claim 1, wherein the first access tunnel is configured to enable the tool to be passed through the first module, and into the bore of the manifold.

6. The system of claim 1, wherein the processing device comprises a pump, a process fluid turbine, an injection apparatus for injecting gas or steam, a chemical injection apparatus, a chemical reaction vessel, a pressure regulation apparatus, a fluid riser, a measurement apparatus, a temperature measurement apparatus, a flow rate measurement apparatus, a constitution measurement apparatus, a consistency measurement apparatus, a gas separation apparatus, a water separation apparatus, a solids separation apparatus, a hydrocarbon separation apparatus, or a combination thereof.

7. The system of claim 1, wherein the processing input comprises a first processing conduit forming a first flowpath extending between a production bore of the manifold and the processing device, and wherein the processing output comprises a second processing conduit forming a second flowpath extending between the processing device and a first choke aperture on the tree manifold.

8. The system of claim 7, comprising:

a diverter for diverting flow from a well, comprising:

a first flow path, comprising:

a first input coupleable to the production bore of the tree manifold; and a first output coupleable to a first processing aperture of the processing device, wherein the processing device is configured to process fluids from a well; and a return flowpath, comprising:

a second input coupleable to a second choke aperture of the processing device; and a second output coupleable to a choke body on the tree manifold.

9. The system of claim 8, comprising a second processing device coupleable to the first processing device.

10. The system of claim 8, comprising the tree manifold and the processing device.

11. The system of claim 1, wherein the first module is configured to couple to a second module configured to process fluid from a well, and wherein the first access tunnel extending through the processing device of the first module is configured to align with a second access tunnel extending through a second processing device of the second module.

12. The system of claim 11, wherein the second module is coupled in series with the first module.

13. The system of claim 1, wherein the first module comprises:

a rigid structure, comprising:

an first upper interface; and a first lower interface coupleable to the manifold; and wherein the processing device is contained between the first upper interface and the first lower interface, and wherein the first access tunnel extends through the rigid structure.

14. The system of claim 13, comprising:

a second module, comprising:

a second rigid structure, comprising:

a second upper interface;

a second lower interface coupleable to the first upper interface; and a second processing device contained between the second upper interface and the second lower interface; and a second access tunnel extending through the second rigid structure and the second processing device, wherein the second access tunnel is configured to align with the first access tunnel.

15. The system of claim 14, wherein first module and the second module are configured to be stacked on top of one another.

* * * * *